US006640737B2

(12) United States Patent
Chacon

(10) Patent No.: US 6,640,737 B2
(45) Date of Patent: Nov. 4, 2003

(54) RETRACTABLE MULTI-HULLED WATERCRAFT

(76) Inventor: William S. Chacon, P.O. Box 1981, Fort Smith, AR (US) 72902

( * ) Notice: Subject to any disclaimer, the term of this patent is extended or adjusted under 35 U.S.C. 154(b) by 0 days.

(21) Appl. No.: 10/097,666

(22) Filed: Mar. 14, 2002

(65) Prior Publication Data

US 2003/0172862 A1 Sep. 18, 2003

(51) Int. Cl.[7] ..... B63B 1/00

(52) U.S. Cl. ..... 114/61.15; 114/61.18; 114/354

(58) Field of Search ..... 114/61.1, 61.15, 114/61.16, 61.17, 61.18, 61.19, 61.22, 354, 344, 284, 283, 123

(56) References Cited

U.S. PATENT DOCUMENTS

| | | | | | |
|---|---|---|---|---|---|
| 1,683,276 | A | * | 9/1928 | Woods | 114/61.16 |
| 2,850,747 | A | * | 9/1958 | Bouchard, Sr. | 114/344 |
| 3,090,975 | A | * | 5/1963 | Franks | 114/344 |
| 3,203,014 | A | | 8/1965 | Krueger | |
| 3,541,987 | A | * | 11/1970 | Barkley | 114/61.16 |
| 3,760,764 | A | * | 9/1973 | Jones et al. | 114/61.16 |
| 3,860,982 | A | * | 1/1975 | Rumsey | 114/344 |
| 3,937,166 | A | * | 2/1976 | Lindsay | 114/123 |
| 3,981,259 | A | | 9/1976 | Harper | |
| 4,048,685 | A | | 9/1977 | Gail | |
| 4,392,444 | A | * | 7/1983 | Andersson | 114/39.28 |
| 4,406,239 | A | | 9/1983 | Enzmann | |
| 4,494,472 | A | * | 1/1985 | Rougerie | 114/66 |
| 4,691,657 | A | * | 9/1987 | Kovac | 114/344 |
| 4,856,446 | A | | 8/1989 | Herard | |
| 4,981,100 | A | * | 1/1991 | Bergeron | 114/344 |
| 4,993,340 | A | | 2/1991 | Pepper | |
| 5,042,411 | A | | 8/1991 | Krolczyk | |
| 5,174,232 | A | | 12/1992 | Broddy | |
| 5,184,565 | A | | 2/1993 | Matthews | |
| 5,235,925 | A | * | 8/1993 | Farrier | 114/61.16 |
| 5,237,947 | A | * | 8/1993 | Manning | 114/61.16 |
| 5,277,142 | A | | 1/1994 | Connor | |
| 5,517,940 | A | * | 5/1996 | Beyer | 114/354 |
| 5,522,339 | A | | 6/1996 | Pelly | |
| 5,826,533 | A | | 10/1998 | Stangroom et al. | |
| 5,915,321 | A | | 6/1999 | Fountaine | |
| 6,029,598 | A | | 2/2000 | Stoll | |
| 6,095,073 | A | | 8/2000 | Burkett | |
| 6,164,238 | A | | 12/2000 | Stokes | |

* cited by examiner

*Primary Examiner*—S. Joseph Morano
*Assistant Examiner*—Ajay Vasudeva

(57) ABSTRACT

A catamaran boat that can be sailed or motor driven having a central cabin structure carried above water by a pair or more of retractable hulls whether hulls are extended or retracted. Each hull outboard side has an upward extending hull wall hinged close to the edge of roof on two opposing sides of cabin structure so as to allow hulls to swing retract under the cabin structure, swinging from these hinges attached close to the roof. Each hulls inboard side has retraction guiding means for rolling or sliding on tracks which are attached to cabin structure's underside and end wise attached to a outer surrounding frame. A pair of dual threaded shafts with opposite threaded brackets attached to inboard side forward and rearward end of each hull functions to spread hulls apart or return closer together.

20 Claims, 6 Drawing Sheets

12F
14D & 16D 14A
12D
12B
12C
12E
12D
12B
14
16
5
5
12A
16B
16B
16B
15
15
15
16A
16A
16C
11
12

25
26
12F
13
13
25
26

11A
12
12D
12F
34
16C
16A
15
16B
32
33
28
29
27
12A
14B
14A
31
14C
12B

RETRACTABLE MULTI-HULLED WATERCRAFT

CROSS-REFERENCE TO RELATED APPLICATIONS

Not applicable

1. Background—Field of Invention

The present invention relates to boats of a catamaran type which have a center cabin structure attached to two floating hulls capable of being retracted under said cabin structure to minimize vessel width for maneuvering in crowded marinas, for transporting on a trailer over land, and for minimizing storage space.

2. Background—Description of Prior Art

Catamarans have been used for centuries in the form of two hulls connected in parallel relation for commercial and exploratory purposes. The superior nautical qualities of shallow depth, speed, and stability advantages due to the catamarans high width-to-length ratio thus eliminating the need for large heavy ballasted keels results in the catamarans resistance to capsizing, less weight and greater speed. Catamarans also have a larger living area for their length over trimarans three hulled cousins. Despite these obvious and well known advantages, the catamarans have often had difficulty maneuvering in relatively tight marina docking areas, or packed anchorage areas due to their comparatively massive vessel width. Additionally these wonderfully performing vessels are difficult to transport by trailer over land because of their vessel width. Many boat owners prefer to remove their boats from the water in the winter months to forestall fouling of the boat bottom and thereby greatly reduce the maintenance that otherwise would be necessary if the catamaran were left in the water all year long. Because of the increased difficulty, inconvenience and time lost in the handling, transportation, and storage of conventional catamaran cabin type boats, many would be catamaran owners instead buy a single hulled boat having a large heavy ballasted bottom keel.

To overcome these problems, there have been attempts in the past to design twin-hulled type vessels which collapse into a transportable package, but these designs have been unseaworthy or tent type or cabin structures lacking width stability. Attempts have been made to modify single hulled vessels into trimarans by adding outrigger hulls which are useless for cabin occupancy thus lacking the cabin space that a catamaran with a cabin offers.

U.S. Pat. No. 4,766,830 issued to Kunz discloses a catamaran with a collapsible frame. The reference teaches the use of a tubular frame which is made up of four aft central sub-frame assemblies. The inflatable hulls are then attached to the underside of the sub-frame assemblies. The present invention differs from this invention in that the present invention involves a twin-hulled vessel wherein each hull swing retracts under a central cabin structure by swinging from a row of pivot hinges located close to roof on two opposing sides of said cabin structure. In the same manner or for the same reasons the present invention likewise differs from the following inventions:

U.S. Pat. No. 6,164,238 issued to Scott Alan Stokes,
U.S. Pat. No. 6,029,598 issued to Richard A. Stoll,
U.S. Pat. No. 4,048,685 issued to William A. Gail,
U.S. Pat. No. 5,915,321 issued to Jean-Francois Fountaine,
U.S. Pat. No. 6,695,073 issued to Jerry D. Burkett,
U.S. Pat. No. 5,826,533 issued to James E. Stangroom and John G. Clancy, U.S. Pat. No. 5,522,339 issued to Charles W. Pelly,
U.S. Pat. No. 5,174,232 issued to Graeme J. Broddy,
U.S. Pat. No. 5,277,142 issued to Dennis P. Connor,
U.S. Pat. No. 5,042,411 issued to Ronald G. Krolczyk,
U.S. Pat. No. 5,184,565 issued to Keith R. Matthews,
U.S. Pat. No. 4,993,340 issued to Orlyn G. Pepper,
U.S. Pat. No. 4,856,446 issued to Yves Herard,
U.S. Pat. No. 4,406,239 issued to Klaus Enzmann,
U.S. Pat. No. 3,981,259 issued to William H. Harper,
U.S. Pat. No. 3,203,014 issued to Clifford H. Krueger.

The present invention differs from all above listed inventions in that the present invention involves a multi-hulled vessel wherein each said hull swing retracts under said central cabin structure by swinging from a row of said pivot hinges located close to roof on two opposing sides of said cabin structure. Moreover the present invention involves inboard side hull rollers or sliders that are guided to roll or slide on a system of parallel spaced apart out ward extending tracks or channels.

OBJECTS AND ADVANTAGES

The present invention relates to a retractable multi-hulled vessel which is simple to vary vessel width of watercraft yet be strong and light. More particularly, it is an object of the present invention to with ease be able to reduce vessel width for trailer towing over land or maneuvering in crowded waters as well as to widen vessel width for stability and added usable space. An additional object of the present invention is to have each hull space able to be accessed from inside the main living area when hulls are extended as well as have the main living area livable when hulls are retracted in crowded waters.

SUMMARY OF THE INVENTION

The present invention provides a catamaran boat which goes far to overcome the problems of prior art. A retractable multi-hulled watercraft according to this present invention has a central cabin structure with a roof, some walls, and a floor structure which has a underside track system. This cabin structure is carried above water by two or more retractable hulls whether hulls are extended or retracted. Each of these said hulls has a upward extending hull wall with top end pivot hinged close to roof on two opposing sides of said cabin structure and bottom end either hinged or securely fastened to outboard side of each said hulls in such a manner as to enable said hulls to swing retract under said cabin structure. The inboard sides of each said hulls has a roller (or slider) system that are guided to roll (or slide) on said track system that is attached to the bottom of said cabin structure wherein roller (or slider) travel is limited by a outer surrounding frame attached to both ends of each track. Vessel width may be easily varied by uniformly rotating a pair of dual threaded shafts, each having opposite threaded brackets which are attached to inboard sides on forward and aft ends of each said hulls in such a manner that rotating said shafts causes said hulls to either spread apart or move closer together.

When said hulls are extended (spread apart), the space inside each hull becomes usable and accessible from the inside of said cabin structure. The resulting wide vessel width resists capsizing thereby eliminating any need for a large heavily ballasted bottom keel. Hence more living space for its length, less weight resulting in faster speed, plus the ability to travel in shallow waters.

When said hulls are retracted (close together), results in almost half the vessel width while still having livable cabin space and being able to more easily maneuver in crowded waters. Furthermore the reduced vessel width allows the catamaran to be transported over land by trailer. An alternative embodiment discloses a catamaran having a wheel/axle assembly mounted on a struts/cylinders assembly able to have a raised (stowed) position located between two pairs of previously described retractable hulls with hull walls.

Thus the present invention overcomes many of the problems of prior art mono-hull boats, trimaran boats, and catamaran boats. Other advantages, objects, and details of the present invention will become apparent as the following detailed disclosure proceeds.

REFERENCE NUMERALS IN DRAWINGS

Figure 1:
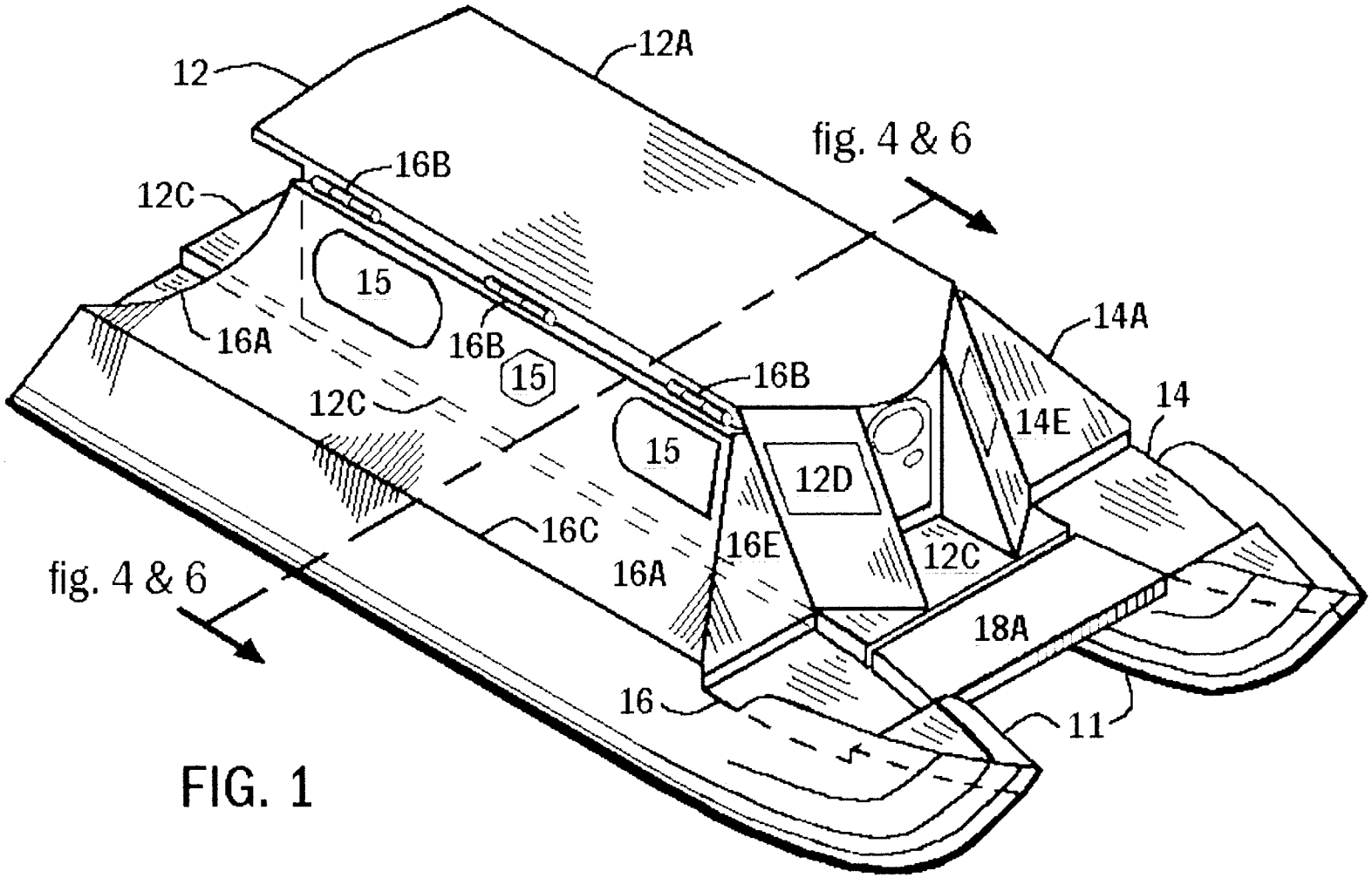
FIG. 1 shows a perspective view of the preferred embodiment with twin hulls in extended position.

| | | | |
|---|---|---|---|
| 11 | preferred embodiment | 11A | alternative embodiment |
| 12 | central cabin structure | 12A | roof |
| 12B | walls | 12C | floor structure |
| 12D | cabin windows | 12E | doors |
| 12F | track (or channel) system | 13 | outer surrounding frame |
| 14 | port side hull | 14A | port hull wall |
| 14B | port wall top end hinge row | 14C | port wall bottom end hinge row |

-continued

REFERENCE NUMERALS IN DRAWINGS

| | | | |
|---|---|---|---|
| 14D | port hull roller (or slider) system | 14E | port forward panel |
| 14F | port aft panel | 15 | hull wall windows |
| 16 | starboard side hull | 16A | starboard hull wall |
| 16B | starboard wall top end hinge row | 16C | starboard wall bottom end hinge raw |
| 16D | starboard hull roller (or slider) system | 16E | starboard forward panel |
| 16F | starboard aft panel | 18A | forward removable deck |
| 18B | pair of aft removable deck panels | 20 | port hull keel |
| 21 | port hull engine | 22 | starboard hull keel |
| 23 | starboard hull engine | 24 | each hull rudder |
| 25 | dual threaded shaft (clock & counter wise) | 26 | pair of opposite threaded brackets |
| 27 | wheels/axle assembly | 28 | struts/cylinders assembly |
| 29 | wheel wells | 30 | port forward hull |
| 31 | port aft hull | 32 | starboard forward hull |
| 33 | starboard aft hull | 34 | towing hitch |

DESCRIPTION OF THE PREFERRED EMBODIMENT

Figures 2, 3, 3A:
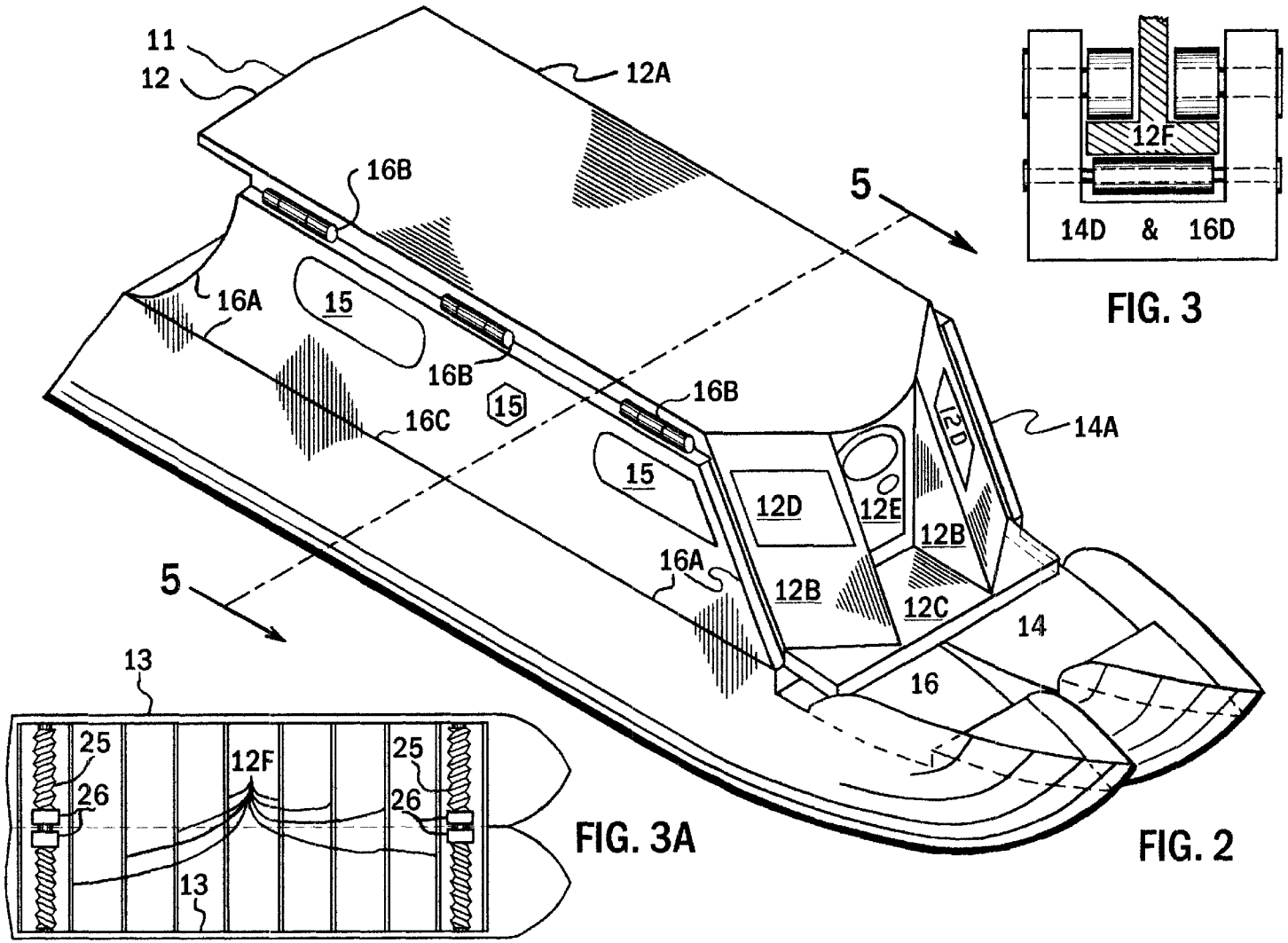
FIG. 2 shows a perspective view of the preferred embodiment with twin hulls in retracted position.
FIG. 3 is a sectional view of one type of roller and track mechanism showing end view of track.
FIG. 3A is a reduced scale top view of a tracks attached to an outer surrounding frame and a pair of dual threaded shafts, each having two opposite threaded brackets attached to each hull.
Figure 4:
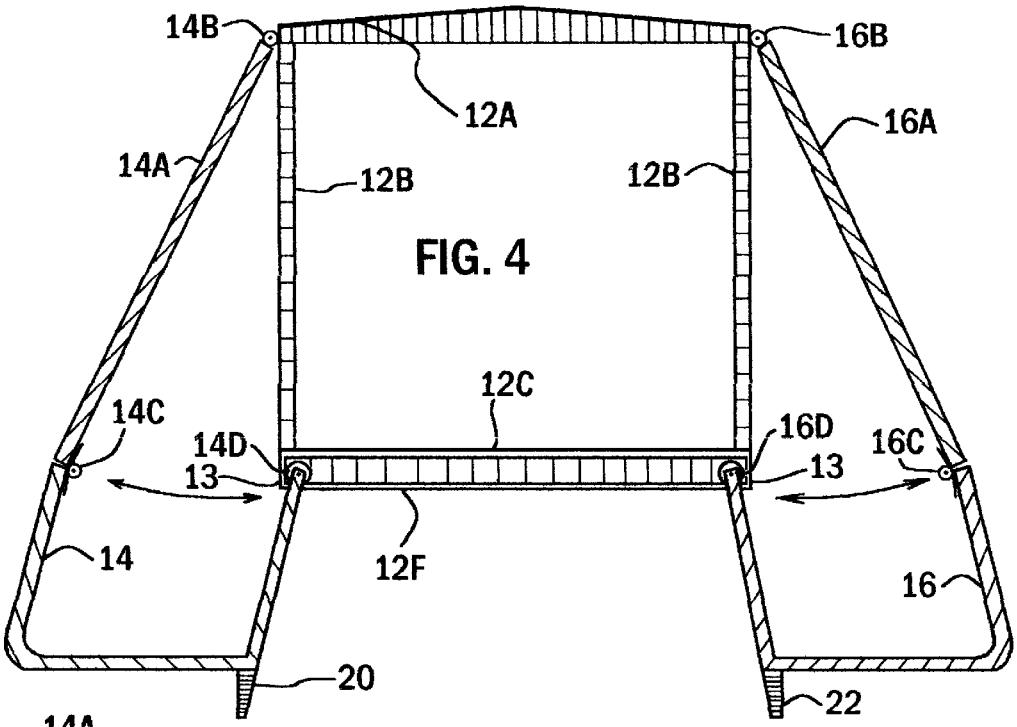
FIG. 4 is a sectional view from rear of the preferred embodiment with hulls in extended position.
Figure 5:
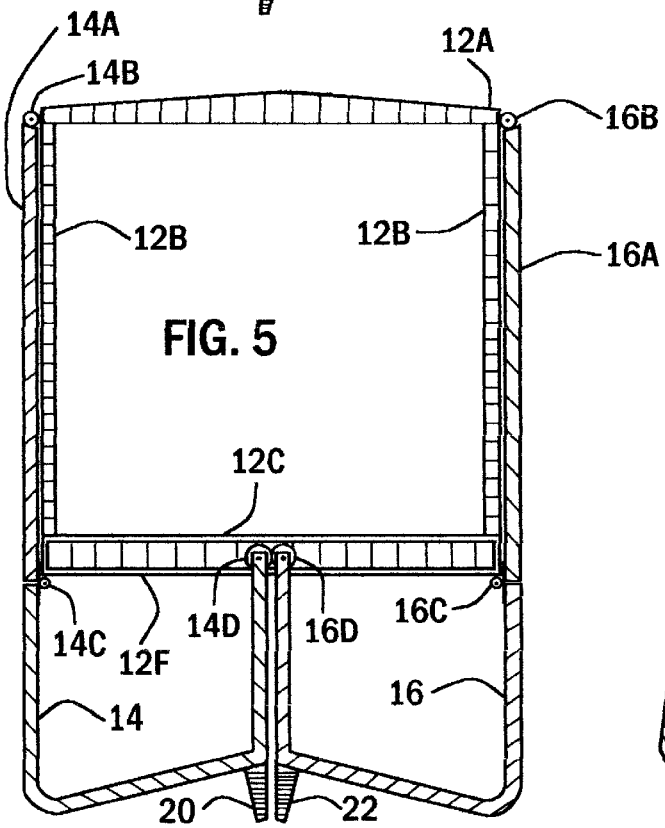
FIG. 5 is a sectional view from rear of the preferred embodiment with hulls in retracted position.
Figure 7:
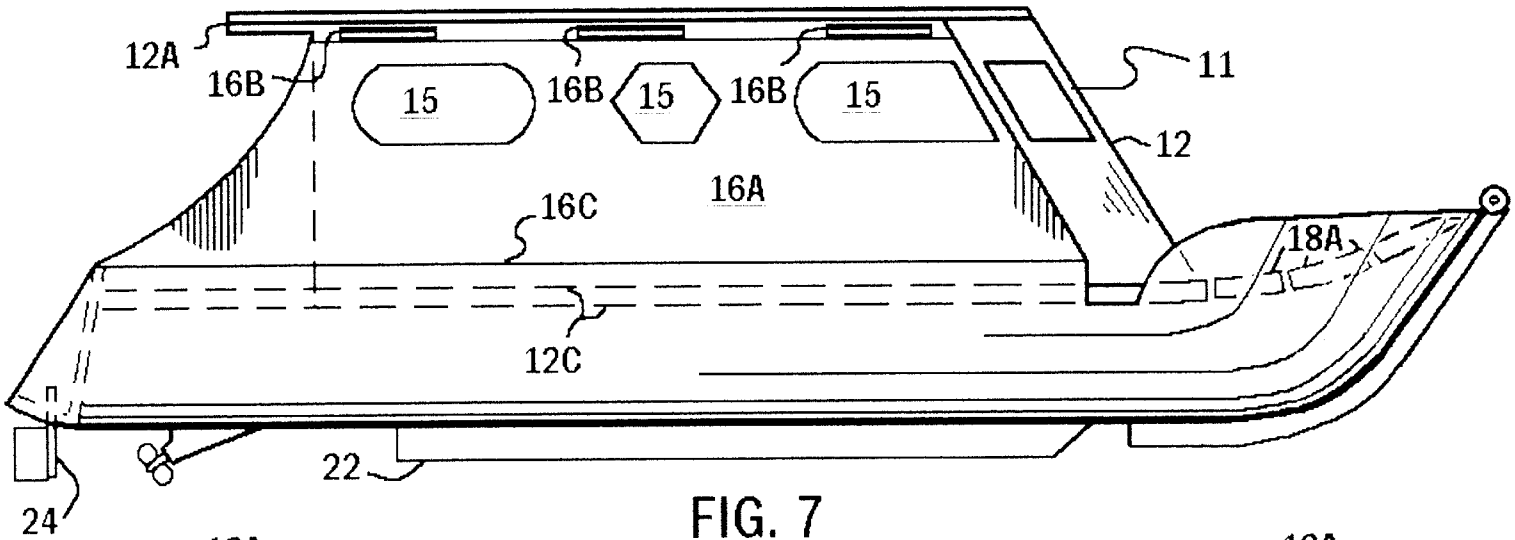
FIG. 7 is a side elevation view with hulls in extended position.
Figure 9:
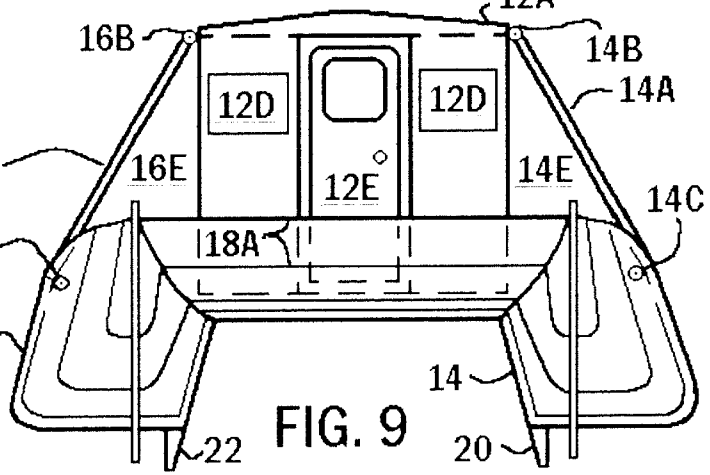
FIG. 9 is a front end elevation view with hulls in extended position.
Figure 8:
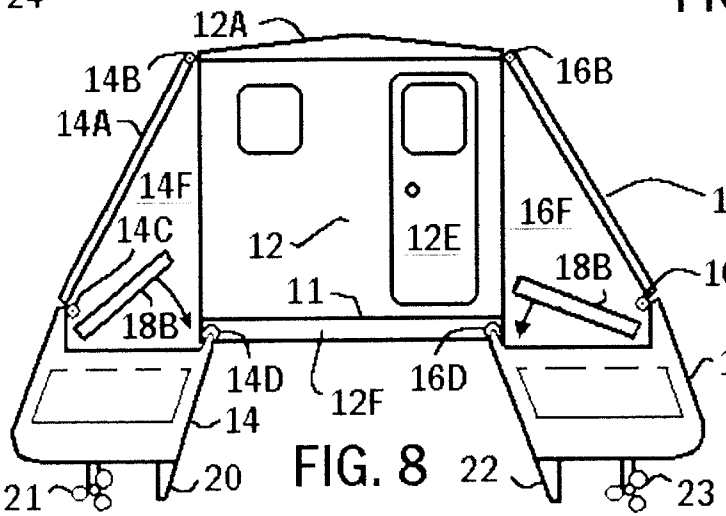
FIG. 8 is a aft end elevation view with hulls in extended position.

A preferred embodiment of the present invention 11 is shown in extended hull position in FIG. 1 (perspective view), FIG. 4 (sectional view), and FIGS. 7,8,9 (elevation views) is a watercraft comprising a horizontal central cabin structure 12 having a roof 12A, a number of walls 12B, a number of windows 12D, a number of doors 12E, and a floor structure 12C in which the underside has a track system 12F consisting of a number of parallel spaced apart outward extending towards the port and starboard sides tracks attached end wise to a outer surrounding frame 13 shown in FIG. 3A. All of which is carried above the water by a port and a starboard longitudinally extending parallel retractable hulls 14 and 16 wherein both swing inward to retract substantially under said structure 12 and swing outward from the port and starboard sides of said cabin structure 12 and carry the weight of said cabin structure 12 whether said hulls 14 and 16 are extended or retracted when floating in water. Referring to FIGS. 4 & 5, a each hull outboard side upward extending port or starboard hull wall 14A or 16A with a port or starboard wall top end hinge row 14B or 16B for port or starboard side pivot attaching close to edge of said roof 12A and a port or starboard wall bottom end hinge row 14C or 16C for pivot attaching close to outboard side of each said hulls 14 and 16 whereby each said hulls swings from each said hinge row pivoting close to the edge of said roof. Included also is a each hull inboard side guiding means such as is shown in FIG. 3 in the form of a port or a starboard hull roller (or slider) system 14D or 16D attached to inboard side of each said hulls 14 and 16 for rolling or sliding on said track system 12F. Said tracks 12F being preferably structural members of said floor structure 12C and said outer surrounding frame 13 attached to each track end functions as a track stop for roller (or slider travel as well as a surface for a water sealing means such as a compressed rubber sealer. Whereby said hulls 14 and 16 are both able to swing retract substantially under said cabin structure 12 and are always held upright. Included also is an extension/retraction means shown in FIG. 3A for spreading apart or returning closer together said hulls 14 and 16 in the form of a pair of dual threaded shafts (clock & counter wise) 25 having a pair of opposite threaded brackets 26 on each said shaft 25, said brackets 26 being attached to inboard sides of each said hulls 14 and 16 forward end and rearward end. Said shafts 25 also being chain or belt sprocket connected so as to rotate uniformly together whereby said brackets 26 move uniformly apart or closer together causing said hulls 14 and 16 to likewise move uniformly apart or closer together. For continuous wall enclosure while in hull extended position as shown in FIGS. 8 & 9, a set of rubber sealed panels namely a port forward panel 14E, a port aft panel 14F, a starboard forward panel 16E, and a starboard aft panel 16F may be inserted between cabin front and aft said walls 128 and each end of said hull wall 14A and 16A.

Figure 6:
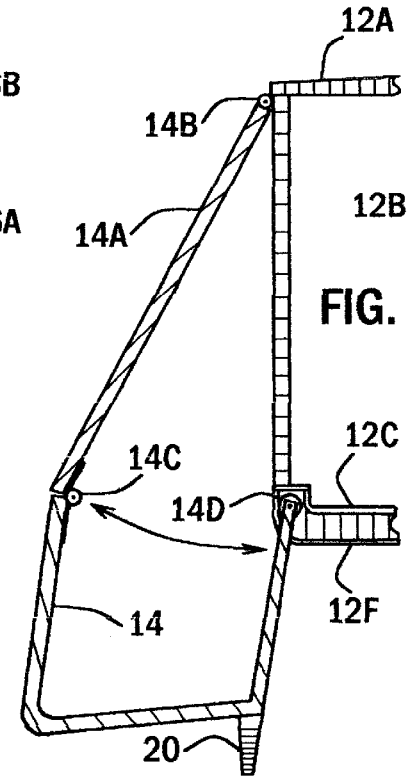
FIG. 6 is a sectional view from rear showing an alternative track curvature.

Preferred embodiment shown in FIGS. 7,8 & 9 includes hull wall windows 15, a forward removable deck 18A, a pair of aft removable deck panels 18B, a port and starboard hull keels 20 and 22, a port and starboard hull engines 21 and 23, a each hull rudder 24, and a sail system (not shown). Preferably said tracks (or channels) 12F are straight as shown in FIG. 4 but said tracks (or channels) 12F could curve upward as shown in FIG. 6 as well as curve downward. The embodiment also includes a water sealing means in the form of rubber seals to be positioned between said hulls 14 and 16 and said cabin structure 12 as well as other locations of possible water entry such as around said panels 14E, 14F, 16E, 16F and along said hinge rows 14B, 14C, 16B, 16C.

OPERATION—FIGS. 3, 3A, 4, 5

Basically said hulls 14 and 16 outboard sides swing from respective said hull walls 14A and 16A pivoting from said hinge rows 14B and 16B located close to said roof 12A of said cabin structure 12 while inboard sides of said hulls 14 and 16 roll (or slide) on said track system 12F, the movement of which is controlled by rotating said dual threaded shafts 25 which move said brackets 26 apart or closer together depending on direction of shaft rotation hence said brackets 26 being attached to inboard sides forward and aft of said hulls 14 and 16 causes likewise hull extending or retracting. As shown in FIG. 4, extending said hulls 14 and 16 for maximum vessel width offers maximum stability, hull access-ability, and vessel width for sailing safety. However for transporting over land or for maneuvering in crowded waters, it is desirable to be able to retract said hulls 14 and 16 for minimized vessel width as shown in FIG. 5. A few preparatory actions need to be performed to permit unobstructed retraction of said hulls 14 and 16 such as:

1) remove and stow said forward removable deck 18A,
2) remove and stow said pair of aft removable deck panels 18B,
3) remove and stow said port forward panel 14E,
4) remove and stow said port aft panel 14F,
5) remove and stow said starboard forward panel 16E,
6) remove and stow said starboard aft panel 16F.

Next, in the proper direction, rotate uniformly together both said shafts 25 thereby causing both said pairs of opposite threaded brackets to move closer together which being attached to inboard sides of said hulls 14 and 16 causing likewise hull movement inward bringing also said rollers (or sliders) 14D and 160 as well as said hull walls 14A and 16A inward into retracted position as shown in FIGS. 2, 3A, and 5. Additional fastening means such as straps may be used as a secondary securing means. Then for spreading hulls apart, one would perform the reverse of the above procedure rotating said shafts 25 in the opposite direction.

DESCRIPTION OF AN ALTERNATIVE EMBODIMENT

Figures 10, 10A, 10B:
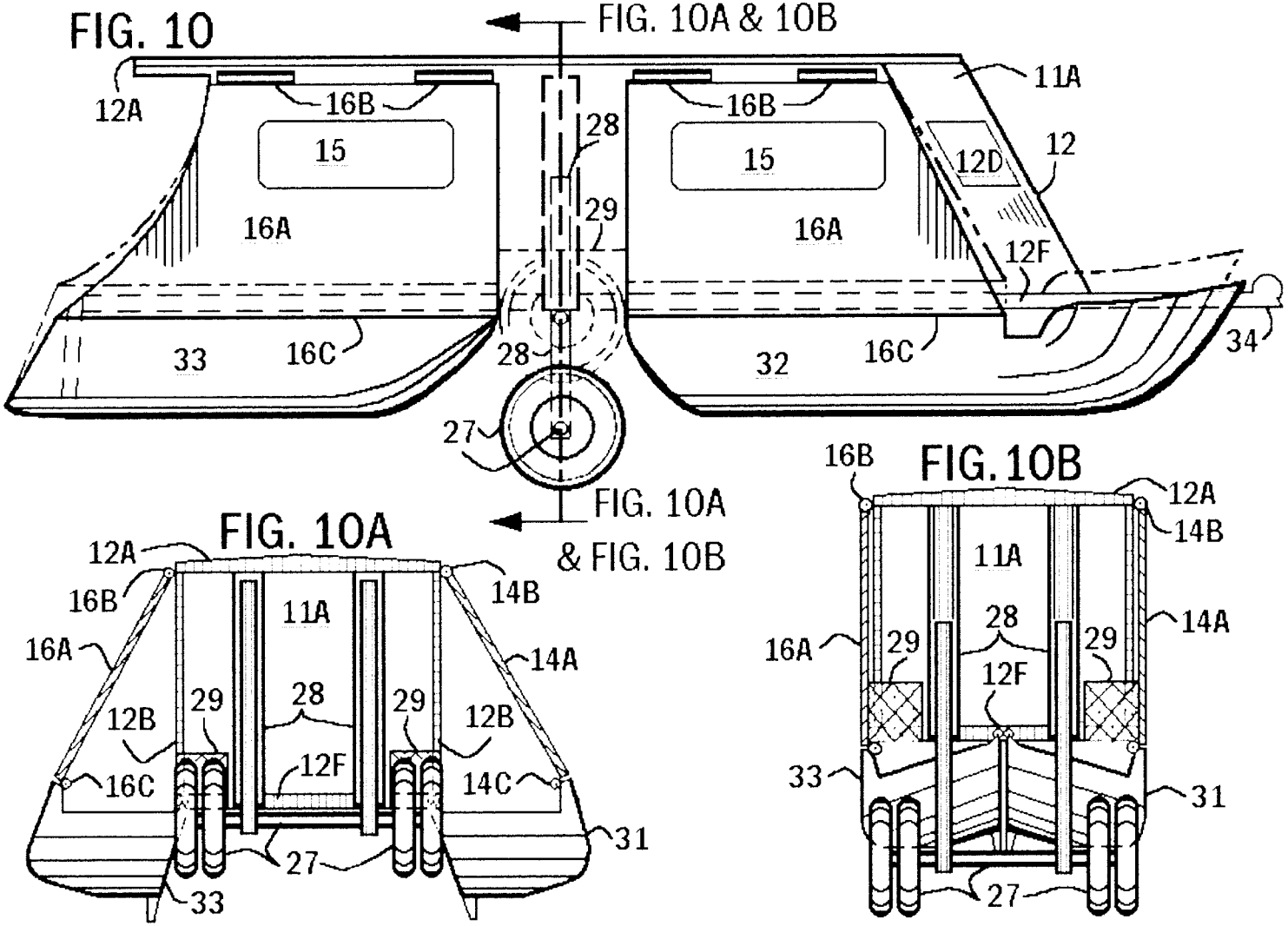
FIG. 10 is a side elevation view of an alternative embodiment showing a wheels/axle assembly having a lowered and raised position being located between forward and aft hulls.
FIG. 10A is a rearward facing sectional view of an alternative embodiment showing rear hulls extended, wheels/axle and struts in raised (stowed) position.
FIG. 10B is a rearward facing sectional view of an alternative embodiment showing rear hulls retracted, wheels/axle and struts in lowered (load carrying) position.

An alternative embodiment 11A of the present invention is shown in FIGS. 10 (elevation view), 10A and 10B (rearward facing sectional views). Instead of one pair of hulls, this catamaran has two pairs of hulls namely a port forward hull 30, a port aft hull 31, a starboard forward hull 32, and a starboard aft hull 33. In addition, this catamaran has a built-in towing means in the form of a tow hitch 34, a wheels/axle assembly 27 mounted on a struts/cylinders assembly 28 capable of having a lowered load carrying position and a raised stowed above water position whereby said wheels/axle assembly 27 can carry this catamaran for land towing purposes and be raised for stowed above water traveling. These lowered and raised positions may be accomplished by varying the pressure inside said struts/cylinders assembly 28 between vacuum and high pressure. Included also are wheel wells 29 for accommodating said wheels/axle assembly 27 located between the two said forward hulls 30, 32 and the two said aft hulls 31, 33. In all other aspects, this alternative embodiment 11B has the same components for extending or retracting each hull as the previously described preferred embodiment 11 except now for said two pairs of hulls 30, 31, 32, 33 including said each hull outboard side upward extending hull wall 14A and 16A with said top end hinge rows 14B and 16B likewise hinged close to edge of said roof 12A with said bottom end hinge row likewise hinged again to hull outboard sides. Again said each hull inboard side guiding means in the form of said hull roller (or slider) system 14D and 16D and track system 12F. Again same extension/retraction means for spreading apart and returning close together said hulls 30, 31, 32, 33 except instead of just one said pair of shafts 25, there are a pair of shafts 25 for the forward hulls and a pair of shafts 25 for the aft hulls. Thus the operation of extension or retraction is the same as the preferred embodiment 11.

ADDITIONAL EMBODIMENTS

Figure 4A:
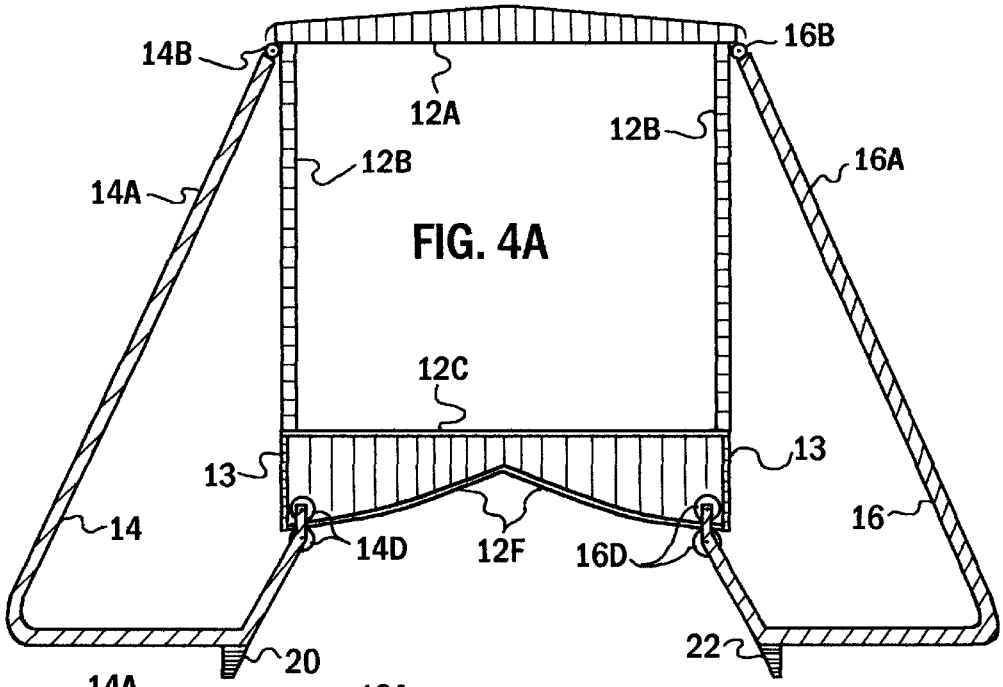
FIG. 4A is an alternative embodiment sectional view similar to FIG. 4.
Figure 5A:
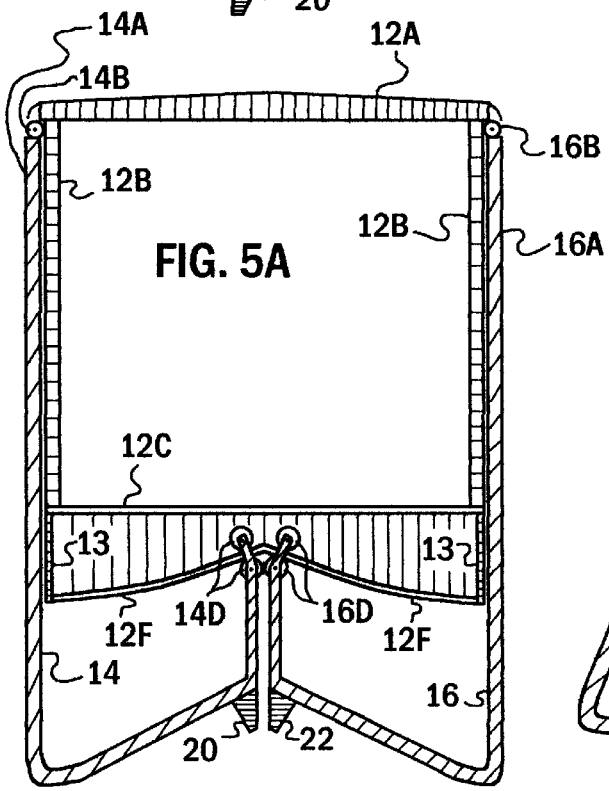
FIG. 5A is an alterative embodiment sectional view similar to FIG. 5.
Figure 6A:
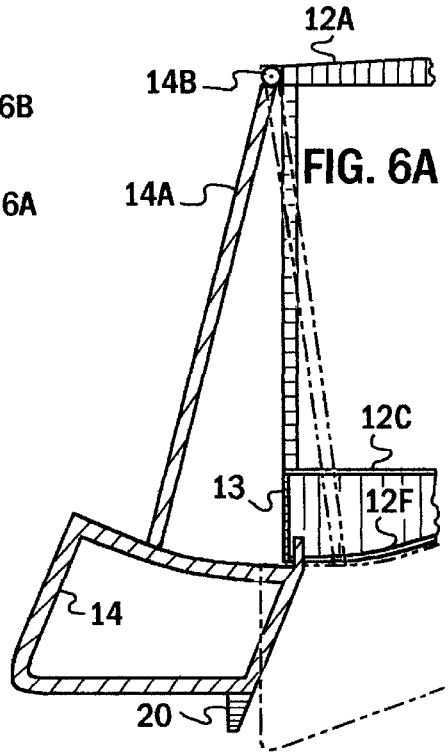
FIG. 6A is a sectional view showing hull wall (or posts) bottom secured closer to hulls middle.

Additional embodiments are shown in FIGS. 4A, 5A, and 6A. In each case the bottom end of each said hull wall 14A and 16A is non-pivoting secured to each said hulls 14 and 16 instead of being pivot hinged attached. This manner of attachment affects said hulls 14 and 16 angle position during extension/retraction and thereby said track system is curved outwardly downward as shown. The said outer surrounding frame 13 also extends lower functioning as a track stop as well as a water sealing compressed rubber surface. For additional stabilization control to further resist capsizing in particular if one was to add a very large sail system, lateral extending float devices may be added such as prior art outrigger bodies of U.S. Pat. No. 5,829,376.

It will thus be seen that the objects set forth above, among those elucidated in, or made apparent from the preceding description, are efficiently attained and, since certain changes may be made in the above construction without departing from the scope of the invention, it is intended that all matter contained in the above description or shown in the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A retractable multi-hull watercraft comprising:

(a) a horizontal central cabin structure having a roof with port and starboard edges, a plurality of walls, and a floor structure with an underside track system; the underside track system comprising a plurality of parallel, spaced-apart and athwartly disposed tracks attached end-wise to an outer surrounding frame;

(b) port and starboard longitudinally extending parallel retractable hulls, each hull having an outboard side and an inboard side;

(c) each hull outboard side comprising an upwardly extending hull wall; each hull wall having a top-end hinge row and a bottom-end hinge row, the top-end hinge row pivotally attached close to the respective one of said edges of said cabin structure roof, the bottom-end hinge row pivotally attached close to said hull outboard side;

(d) each hull further having an inboard guiding means for rolling or sliding on said underside track system, whereby each outboard side hull wall swings from said top-end hinge row pivoting close to said edge of the roof while each hull inboard side is guided on said underside track system for retraction under said cabin structure thus enabling said hulls to carry the weight of said cabin structure whether said hulls are extended or retracted, the outboard side hull wall being always held upright.

2. The invention as defined in claim 1 therein said hulls comprise elongate floats disposed as mirror image of each other, and constructed as a singular unit or a plurality of segments connected serially.

3. The invention as defined in claim 1 wherein each hull wall comprises a plurality of beams or posts capable of pivoting in unison with said hull wall.

4. The invention as defined in claim 1 further comprising an extension and retraction means for spreading apart and returning closer together said hulls, wherein said extension and retraction means comprise a pair of dual threaded shafts that are threaded both clockwise and counter-clockwise and having a pair of opposite threaded brackets on each shaft, said brackets being attached at forward end and rearward end of the inboard sides of each hull, said shafts having sprocket connecting means so as to rotate uniformly together, whereby said brackets move uniformly apart or closer together causing said hulls to correspondingly and uniformly move apart or closer together.

5. The invention as defined in claim 1 further comprising water sealing means for precluding water entry through joint openings exposed to water while the hulls are disposed in extended position.

6. The invention as defined in claim 1 further comprising propulsion means, wherein the propulsion means is characterized as one or both of an engine propulsion and a sail propulsion; and wherein said engine propulsion comprises one or a plurality of engines, while said sail propulsion comprises one or a plurality of sails.

7. The invention as defined in claim 1 further comprising means for steering and stabilization control, wherein said steering and stabilization control includes a rudder system, a number of keels, and a number of laterally extending float devices.

8. A retractable multi-hull watercraft comprising:

(a) a horizontal central cabin structure having a roof with port and starboard edges, a plurality of walls, and a floor structure with an underside track system; the underside track system comprising a plurality of parallel, spaced-apart and athwartly disposed tracks attached end-wise to an outer surrounding frame;

(b) two pairs of longitudinally extending parallel retractable hulls consisting of a port forward hull, a port aft hull, a starboard forward hull and a starboard aft hull, each hull having an outboard side and an inboard side;

(c) each hull outboard side comprising an upwardly extending hull wall; each hull wall having a top-end hinge row and a bottom-end hinge row, the top end hinge row pivotally attached close to the respective one of said edges of said cabin structure roof, the bottom-end hinge row pivotally attached close to said hull outboard side;

(d) each hull further having an inboard guiding means for rolling or sliding on said underside track system, whereby each outboard side hull wall swings from said top-end hinge row pivoting close to said edge of the roof while each hull inboard side is guided on said underside track system for retraction under said cabin structure thus enabling said hulls to carry the weight of said cabin structure whether said hulls are extended or retracted, the outboard side hull wall being always held upright.

9. The invention as defined in claim 8 further comprising built-in towing means and wheels-axle assembly mounted on a load carrying means, wherein the load carrying means has a lowered load carrying position whereby said wheels-axle assembly supports said watercraft for land towing purposes, and an elevated stowing position for raising wheels-axle above water for water traveling purposes.

10. The invention as defined in claim 8 wherein each hull wall comprises a plurality of beams or posts capable of pivoting in unison with said hull wall.

11. The invention as defined in claim 8 further comprising an extension and retraction means for spreading apart and returning closer together said forward hulls and said aft hulls in unison, wherein said extension and retraction means further comprise a pair of dual threaded shafts for each forward and aft pair of hulls, said shafts being threaded both clockwise and counter-clockwise and having a pair of opposite threaded brackets on each shaft, said brackets being attached at forward end and rearward end of the inboard sides of each hull, said shafts having sprocket connecting means so as to rotate uniformly together, whereby said brackets move uniformly apart or closer together causing said hulls to correspondingly and uniformly move apart or closer together.

12. The invention as defined in claim 8 further comprising water sealing means for precluding water entry through joint openings exposed to water while the hulls are disposed in extended position.

13. The invention as defined in claim 8 further comprising propulsion means, wherein the propulsion means is characterized as one or both of an engine propulsion and a sail propulsion; and wherein said engine propulsion comprises one or a plurality of engines, while said sail propulsion comprises one or a plurality of sails.

14. The invention as defined in claim 8 further comprising means for steering and stabilization control, wherein said steering and stabilization control includes a rudder system, a number of keels, and a number of laterally extending float devices.

15. A retractable multi-hull watercraft comprising:

(a) a horizontal central cabin structure having a roof with port and starboard side edges, a plurality of walls, and a floor structure with an underside track system; the underside track system comprising a plurality of parallel, spaced-apart and athwartly disposed tracks attached end-wise to an outer surrounding frame;

(b) port and starboard longitudinally extending parallel retractable hulls, each hull having an outboard side and an inboard side;

(c) each hull outboard side comprising an upwardly extending hull wall; each hull wall having a top-end hinge row and a bottom end, the top-end hinge row pivotally attached close to the respective one of said edges of said cabin structure roof, the bottom end non-pivotally secured close to said hull outboard side;

(d) each hull further having an inboard guiding means for rolling or sliding on said underside track system, whereby each outboard side hull wall swings from said top-end hinge row pivoting close to said edge of the roof while each hull inboard side is guided on said underside track system for retraction under said cabin structure thus enabling said hulls to carry the weight of said cabin structure whether said hulls are extended or retracted, the outboard side hull wall being always held upright.

16. The invention as defined in claim 15 wherein said hulls comprise elongate floats disposed as mirror image of each other, and constructed as a singular unit or a plurality of segments connected serially in rows to function as pairs of hulls.

17. The invention as defined in claim 15 wherein each hull wall comprises a plurality of beams or posts capable of pivoting in unison with said hull wall.

18. The invention as defined in claim 15 further comprising water sealing means for precluding water entry through joint openings exposed to water while the hulls are disposed in extended position.

19. The invention as defined in claim 15 further comprising propulsion means, wherein the propulsion means is characterized as one or both of an engine propulsion and a sail propulsion; and wherein said engine propulsion comprises one or a plurality of engines, while said sail propulsion comprises one or a plurality of sails.

20. The invention as defined in claim 15 further comprising means for steering and stabilization control, wherein said steering and stabilization control includes a rudder system, a number of keels, and a number of laterally extending float devices.

* * * * *